United States Patent [19]

Strumbos

[11] Patent Number: 4,491,101

[45] Date of Patent: Jan. 1, 1985

[54] MULTIPLE HEAT-RANGE SPARK PLUG

[76] Inventor: William P. Strumbos, 85 Middleville Rd., Northport, N.Y. 11768

[21] Appl. No.: 529,369

[22] Filed: Sep. 6, 1983

[51] Int. Cl.[3] ..... H01T 13/16

[52] U.S. Cl. ..... 123/169 C; 123/169 R; 313/118; 313/143

[58] Field of Search ..... 123/169 R, 169 C, 169 EL, 123/41.31; 165/104.33; 313/118, 143, 145

[56] References Cited

U.S. PATENT DOCUMENTS

| | | | |
|---|---|---|---|
| 2,096,250 | 10/1937 | Kasarjian . | |
| 2,212,725 | 8/1940 | Andres . | |
| 2,924,642 | 2/1960 | Dart . | |
| 2,935,305 | 5/1960 | Beurtheret . | |
| 2,958,021 | 10/1960 | Cornelison et al. . | |
| 3,130,338 | 4/1964 | Andersen . | |
| 3,543,841 | 12/1970 | Eastman . | |
| 3,605,074 | 9/1971 | Freggens et al. . | |
| 3,612,931 | 10/1971 | Strumbos . | |
| 3,622,846 | 11/1971 | Relmers . | |
| 3,627,899 | 12/1971 | Moore . | |
| 3,731,660 | 5/1973 | Leffert . | |
| 3,743,877 | 7/1973 | Strumbos . | |
| 3,759,443 | 9/1973 | Fletcher et al. . | |
| 3,838,668 | 10/1974 | Hays et al. . | |
| 3,933,198 | 1/1976 | Hara et al. . | |
| 3,950,947 | 4/1976 | Dirne et al. . | |
| 3,963,012 | 6/1976 | Harned . | |
| 4,013,047 | 3/1977 | Harned . | |
| 4,361,122 | 11/1982 | Latsch | 123/254 X |
| 4,394,855 | 7/1983 | Latsch et al. | 123/254 |
| 4,416,228 | 11/1983 | Benedikt et al. | 123/169 EL X |

*Primary Examiner*—Tony M. Argenbright

[57] ABSTRACT

A spark plug having a heat pipe located between the insulating core and the shell in the skirt portion thereof to vary the heat range automatically in response to the operating conditions of the engine in which it is fitted. The heat pipe is charged with a non-condensible gas and a working medium that undergoes a phase change at a predetermined design temperature to transport heat by means of an evaporation-condensation cycle from the firing end of the spark plug to prevent the overheating thereof. Below the design temperature, the heat pipe is thermally non-conducting such that the firing end of the spark plug is allowed to reach a temperature that will burn off combustion deposits that cause misfiring. In one embodiment, the heat pipe is fabricated as a separate integral annular element which is installed in the skirt of the spark plug during the manufacture thereof. In another embodiment, the separate integral heat pipe element has a thin-wall construction in which a resilient wire-screening wicking system provides the required structural integrity and a thin-walled envelope acts as a containment system for the working medium. In further embodiments, the open end of the skirt of the spark plug itself is sealed off with an end wall such that a heat pipe is formed in the annular volume between the insulating core and the shell bore.

16 Claims, 11 Drawing Figures

CONVENTIONAL "HOT" PLUG

CONVENTIONAL "COLD" PLUG

FIG. 9
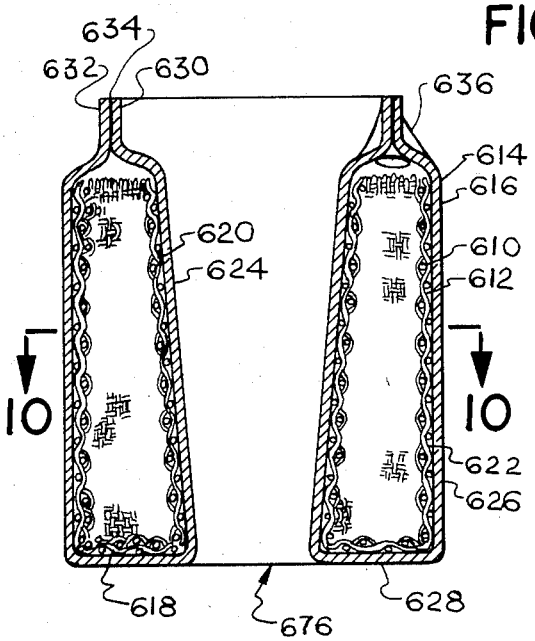
FIG. 8
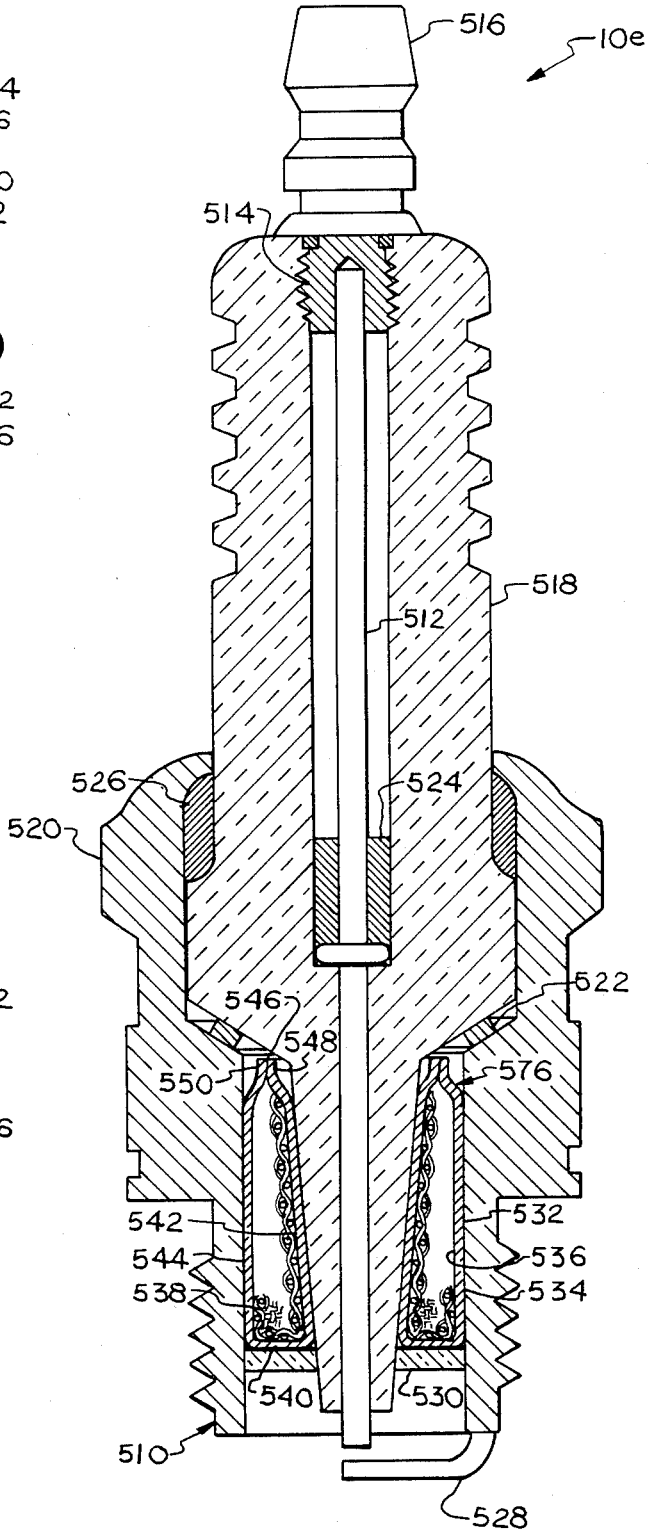
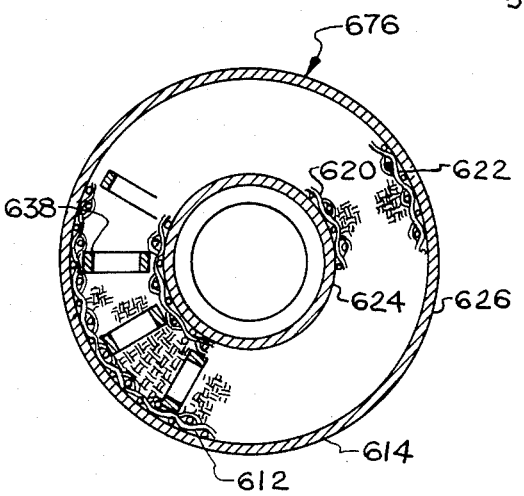
FIG.10

MULTIPLE HEAT-RANGE SPARK PLUG

BACKGROUND OF THE INVENTION

1. Field Of The Invention

This invention relates to a spark plug for internal combustion engines and, more particularly, to a spark plug which is provided with heat pipe means to vary the heat range of the spark plug automatically.

2. Background Of The Invention

Spark plugs, particularly those in high-speed, high-compression engines, are subjected to an extreme range of pressure and temperature conditions. Plug temperatures range from about 200° C. (392° F.) at low engine speeds and light loads, to as high as 850° C. (1562° F.) under full throttle, full load. Below about 450° C. (842° F.), carbon and other products of combusting begin to form on the plug insulator nose. If not removed, those deposits build up until current shorts through the deposits instead of sparking across the electrodes. At normal speeds, enough heat is usually generated to burn those deposits away as quickly as they are formed. However, when high speeds or heavy loads raise the plug temperatures above 600° C. (1112° F.) to 700° C. (1292° F.), deposits not burned away, particularly those resulting from the additives in currently available fuels and lubricants, are melted to form a glaze coating on the plug insulator nose. When hot, this glaze is highly conductive and the plug is shorted out. This causes misfiring with consequent fuel and power losses. Should plug temperatures becomes excessive, the plug points themselves become hot enough to ignite the fuel-air mixture in the cylinder. This causes auto-ignition and, if continued, can lead to the destruction of the plug and serious engine damage. Overheated spark plug electrodes also cause a condition commonly met in two-stroke engines: the bridging of the electrodes due to the build-up of conducting deposits formed by combustion particles which have melted upon their striking the overheated electrodes. In plug temperature ranges above 850° C., chemical corrosion and spark erosion cause plug failure within a very short time.

It will be seen then, if a hot-type plug is subjected to high compression pressures, temperatures, and loads, electrode buring and auto-ignition will result because of the plug's slow rate of heat transfer. A cold plug, because it will not reach full operating temperature, will not tolerate low-speed, light-load operation for any length of time without becoming fouled with current-conducting deposits. Because a cold plug under such conditions will not reach a temperature required to burn off fouling, carbon formation as well as additive particles from the fuel and oil condensing on the comparatively cool surfaces of the insulator will foul the plug and will cause it to misfire.

Spark plugs are customarily supplied in various heat ranges to handle the requirements of individual engines and operating conditions. Heat range refers to the ability of the plug to conduct the heat of combustion away from the electrodes or firing end. As shown in FIG. 1, a conventional hot-type plug will have a long insulator nose 2. Because of the length of the heat path (as indicated by the arrows (3), heat thus will be transferred comparatively slowly from the plug firing end to the engine cooling system. A conventional cold-type plug (FIG. 2), on the other hand, has a comparatively short insulator nose 4 and heat is transferred rapidly (as indicated by the arrows 5) in to the engine's cooling system.

3. Description Of The Prior Art

The prior art discloses several examples of spark plugs incorporating means which are intended to vary the heat range thereof automatically such that the device can accommodate a wider than normal spectrum of operating conditions. In one such example in the prior art disclosed by P. G. Andres in U.S. Pat. No. 2,212,725, a skirt having segments of bimetallic material is positioned on the ceramic insulator with a gap therebetween in the cold condition. As the plug firing end heats up in operation, the segments contract to close the gap such that heat travels up the skirt to expedite the transfer of heat from the firing tip. Inasmuch as the conductance of heat between two bodies such as between the skirt and the insulator is dependent upon the establishment of a good thermal contact, and the design in the cited Andres patent is such that any appreciable degree of plug fouling will adversely effect the thermal contact, the performance characteristics of the device is likely to be erratic and difficult to maintain under the expected operating conditions. In another such spark plug disclosed by H. W. Andersen in U.S. Pat. No. 3,130,338, a similar segmented skirt of bimetallic material is fitted on the ceramic insulator in the area above the lower insulator gasket of the spark plug. Although that Andersen design will have some effect on the overall spark plug temperatures, it does not appear that it would effect to any approciable extent the temperature of the nose or firing end of the spark plug which is the area of concern of the instant invention. The inventor in the present invention has disclosed multiple heat-range spark plugs in U.S. Pat. Nos. 3,612,931 and 3,743,877. In those prior art designs, a heat shunt is provided on the firing tip of the spark plug, said shunt moving into contact with the shell of the spark plug at the design temperature to maintain the firing tip at an optimum operating temperature. In those prior art designs, the heat shunts are fabricated out of metal; this factor implies a certain restriction on the freedom of design.

In the prior art, A. A. Kasarjian, in U.S. Pat. No. 2,096,250, discloses a spark plug that has a hollow longitudinal space in the center electrode extending substantially the length thereof, the space being nearly filled with a material possessing high heat conductivity. In the design of Kasarjian, the conductivity of the said material absorbs heat from the firing tip and carries it to the cooler parts of the spark plug, by convection as well as by conductance, and dissipates it there. Inasmuch as the longitudinal space in the center electrode is filled with the cooling medium with the exception of a small void to compensate for the thermal expansion of the medium, it will be seen that the cooling means in the spark plug of kasarjian does not use the heat pipe principle involved in the operation of the subject invention.

SUMMARY OF THE INVENTION

In this invention, the heat range of the spark plug is varied automatically by a predetermined evaporation-condensation cycle of a heat transfer substance contained in a heat pipe incorporated in the skirt of the spark plug between the insulator core and the shell. The heat transfer substance can be any suitable element or compound that vaporizes at about the desired design temperature of the spark plug, which can range from approxiamtely 450° C. (842° F.–850° C. (1562° F.), preferably about 538° C. (1000° F.).

The spark plug of this invention, except for the use of heat pipe technology which is employed to maintain the firing end at an optimum operating temperature, is essentially of standard construction with the nose of the insulator core having a length found normally in a very hot-type spark plug. A conventional terminal stud, center electrode, shell, ground electrode, and sealing means is employed. In one embodiment of my invention, the open end of the skirt of the spark plug between the insulator core and the shell at the firing end is sealed off to form an annular chamber. A suitable working fluid is placed in the chamber. Capillary means such as a wall wick can be provided if required. In addition, an inert, non-condensible gas can also be provided in the chamber for controlling more closely the temperature at which the heat pipe becomes thermally conductive. In a further embodiment, the heat pipe is fabricated as a separate integral element which is inserted in the annular space between the spark plug insulator and the shell. An electrically insulating end wall can be provided to retain the heat pipe in place and to shield it from fouling. Further, the integral heat pipe element can have a thin-wall construction in which a resilient wire-screening wicking system provides the required structural integrity and a thin-walled envelope serves as a containment system for the working medium.

The principal object of this invention is to provide means for varying the heat range of a spark plug automatically to thus keep the plug at the most effective temperature during all operating conditions to thereby improve starting, warm-up, idling, low- and high-speed operation of the engine. And, further, to accompany such improvement in engine performance with an efficient spark plug design that reduces the causes of misfiring so that the engine produces greater power and increased fuel economy in all speed ranges.

A further object of the invention is to provide a spark plug which incorporates a heat pipe to vary automatically the heat range to keep the firing end in an optimum design temperature range.

It is another object of this invention to provide a multiple heat range spark plug whose operating temperature is automatically varied such that the plug runs hot at the lower cylinder temperatures occurring when the engine is idling or at low speeds and loads to thereby inhibit plug fouling, and which runs relatively cool at higher cylinder temperatures such as those occurring under conditions of high speeds and loads so as to prevent the plug overheating that causes auto-ignition and plug electrode burning.

Another object is to provide a spark plug whose design eliminates the requirement for a specific heat range in a plug so that the number of spark plug types required to be manufactured or that have to be stocked by the dealer are thereby reduced. A concomitant object is to provide a spark plug having a multiple heat range such that the selection of a plug with the proper heat range for a specific engine or for the type of service that the engine will encounter will no longer be a problem such that the possibility of fitting plugs of the wrong heat range in an engine with the attendant probability of poor performance and engine damage and owner dissatisfaction is thereby avoided.

Yet another object is to provide a spark plug having atomatic means for varying the heat range such that an optimum operating temperature is maintained to thereby minimize the plug fouling that leads to the misfiring which results in engine emissions that contribute heavily to environmental air pollution. In addtion, it is an object to provide a plug that will maintain a high standard of performance with engine fuels that have their volatility reduced and have some of their additives and compounds eliminated as a pollution curb.

DESCRIPTION OF THE DRAWINGS

For the purpose of illustrating the invention, there is shown in the drawings the form which is presently preferred; it should be understood, however, that the invention is not necessarily limited to the precise arrangements here

FIG. 8 is a front elevational view partially in section of a still further design of the spark plug of the invention embodying a heat pipe for varying the heat range thereof automatically;

FIG. 9 is a front elevational view of a heat pipe employed in the spark plug of the invention;

FIG. 10 is a sectional view taken along line 10—10 of the heat pipe of FIG. 9.

DESCRIPTION OF THE PREFERRED EMBODIMENTS

Figure 3:
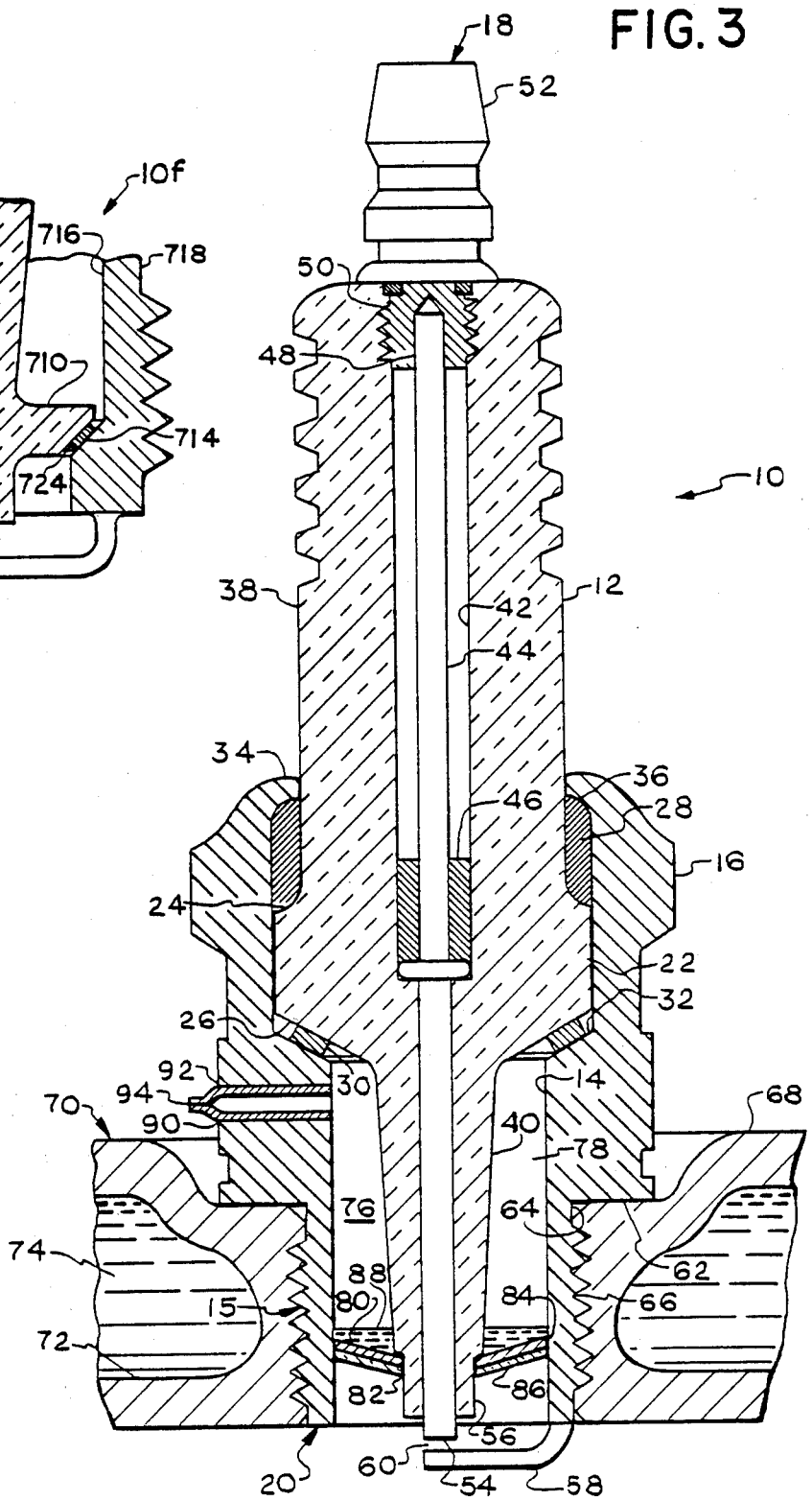
FIG. 3 is a front elevational view partially in section of a spark plug embodying the heat shunting means of the invention.

Referring now to FIG. 3 of the drawings, there is shown a spark plug 10 of the invenion comprising a cylindrical insulator or insulating core 12 positioned in a gas-tight concentric relationship within the bore 14 of a cylindrical metal shell 16. The spark plug has a terminal end 18 which is referred to herein as the upper end and a firing end 20 referred to as the lower end. This terminology "upper" and "lower" is employed merely as a matter of convenience herein and has no orientational significance as the spark plug can be installed in the engine with the firing end uppermost or in any other orientation. The insulator 12 is formed of alumina or other suitable material in a conventional manner with an annular shoulder 22 having an upper surface 24 and a lower surface 26. A sillment seal 28 is used on the upper surface 24 between the insulator and the bore 14 of the shell and a sealing gasket 30 is provided between lower surface 26 and an annular ramped portion or ledge 32 formed in the bore of the shell. With this well-known arrangement, when the upper rim 34 of the shell is spun down on the upper part 36 of the seal 28, the insulator 12 is locked in a gas-tight relationship in the shell 16. The insulator has a body portion 38 and a tapered tip or nose portion 40 and is provided with a concentric longitudinal bore 42 within which a center electrode 44 is secured. A sillment seal 46 in the insulator bore 42 provides a gas-tight seal for the center electrode 44, the upper end 48 of which is fixed in a stud 50 on which is fastened the terminal 52 of the spark plug. As is well known, the high tension lead from the distributor of the engine's ignition system connects to terminal 52. The lower end 54 of the center electrode 44 protrudes from the lower end 56 of the insulator 12 and constitutes a firing tip which is suitably spaced from a ground electrode 58 such that a spark gap 60 is formed therebetween. A standard ground electrode installation is shown, but it will be appreciated that any other suitable design such as a J-gap or a multiple-electrode installation and the like can be utilized. Shell 16 has an annular external shoulder 62 below which is a length of reduced diameter 64 which is threaded for engagement in the usual manner in a threaded bore 66 in the cylinder head 68 of an engine 70. A copper gasket (not shown) can be provided as required as a sealing means between shoulder 62 and cylinder head 68. Cooling means, typically passages 72 through which is circulated a suitable coolant fluid 74, are provided in the cylinder head. Inasmuch as the engine forms no part of my invention, it will be recognized that the details thereof are given merely for expository purposes to show the environment of use of the inventive spark plug.

It will be appreciated also that the spark plug as described to this point is substantially a conventional spark plug fabricated with well-known materials using suitable known techniques. My invention resides in the provision of a heat-shunting heat pipe 76 in the lower end or skirt 15 of the spark plug between the insulator 12 and the shell 16. Heat pipe 76 comprises an annular chamber 78 between the nose portion 40 of the insulator and the bore 14 of the shell, the lower end of which chamber is hermetically sealed by an annular end wall 80. The inner periphery 82 of end wall 80 is bonded on the nose of the insulator and the outer periphery 84 is bonded on the bore 14 of the shell by any suitable bonding means. A suitable bonding agent which is rated to temperatures up to 1650° C. is a ceramic adhesive "Ceramabond", marketed by Aremco Products, Inc., Briarcliff Manor, New York. It will be appreciated that the upper end of the chamber 78 is hermetically sealed by seal 28 and gasket 30 of the spark plug. To avoid an electrical path across the end wall it can be made of an electrical non-conductor such as a ceramic, or a suitable electrical insulator 86 can be bonded on the lower surface thereof. Heat pipe 76 is charged with a suitable working substance 88 by means of a fill tube 90 which is fixed in an aperture 92 passing through the wall of the shell of the spark plug. After the heat pipe has been charged, the end 94 of the fill tube 90 is sealed, typically by swaging and welding the end.

The working medium of the heat pipe can be selected from a number of suitable substances. The criterion used in the selection is that the heat pipe should keep the firing tip at its proper operating temperature. With presently availabe gasolines, the spark plug must operate above a temperature of 450° C. (842° F.) to avoid fouling: to avoid self-ignition, the spark plug firing end must not exceed about 927° C. (1700° F.). In addition, the working medium employed must be compatible with the materials used in the spark plug and the substance should not decompose due to the operating temperatures or because of thermal cycling. At the temperatures encountered in the operation of the spark plug, the alkali metals such as lithium or preferably sodium are suitable for use. In addition to the proper charge of sodium, a small percentage, say about 5% of the volume of the heat pipe can be occupied by an inert non-condensible gas, typically nitrogen. So charged, the heat pipe will be non-conducting below about 538° C. (1000° F.) and will be fully conducting at about 760° C. (1400° F.). By varying in a known manner the working fluid and quantity of inert gas, different non-conducting/conducting temperature ranges can be achieved. Should the requirements dictate, a portion of or all of the inside surfaces of the heat pipe can be provided with capillary pumping means such a wicking and the like.

In operation with the spark plug installed in an engine, the combustion processes in the engine cylinder when the engine is started and running cause a rapid rise in the temperature of the spark plug. Because of the relatively long insulator nose and the poor heat transfer characteristics of the ceramic from which it is formed, the heat buildup puts the firing tip of the insulator nose into a temperature range that burns off deposits settling thereon. When engine load or speed causes the cylinder operating temperatures to soar, the heat transfer medium in the heat pipe in the spark plug first melts, then vaporizes. The vapors encountering the relatively cool walls of the spark plug shell will be condensed. This condensed vapor runs back down the shell wall to the lower end of the heat pipe where it is again vaporized by the hot insulator (and end wall). The change of state of the heat transfer substance when it vaporizes extracts heat from the firing end of the spark plug to cool it and the phase change when the substance condenses transfers the heat to the shell upon which the vapor condenses and the heat passes through the shell and is dissipated into the engine cooling system. Because the heat of evaporation is absorbed by the phase change from liquid to vapor and released when condensation of the vapor takes place, large amounts of heat can be transported with very small temperature gradients from areas of heat addition to areas of heat removal. Should the heat pipe be provided with capillary means such as wicking, the fluid circulation in the evaporation-condensation cycle is expedited by the pumping action of the capillary means.

Figure 1:
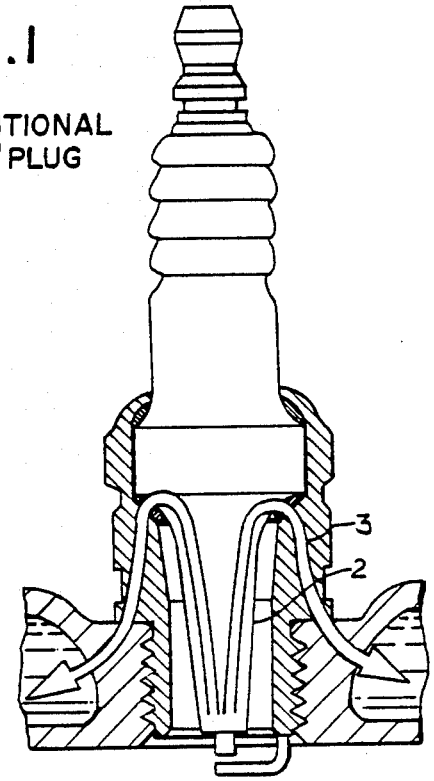
FIG. 1 is a front elevational view in partial longitudinal section of a prior art spark plug of the hot type in its operating environment in an engine cylinder head.
Figure 2:
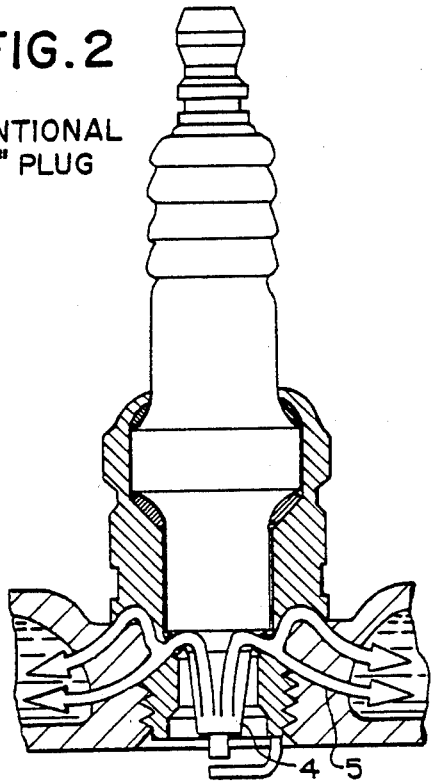
FIG. 2 is a similar view of a prior art spark plug of the cold type.
Figure 4:
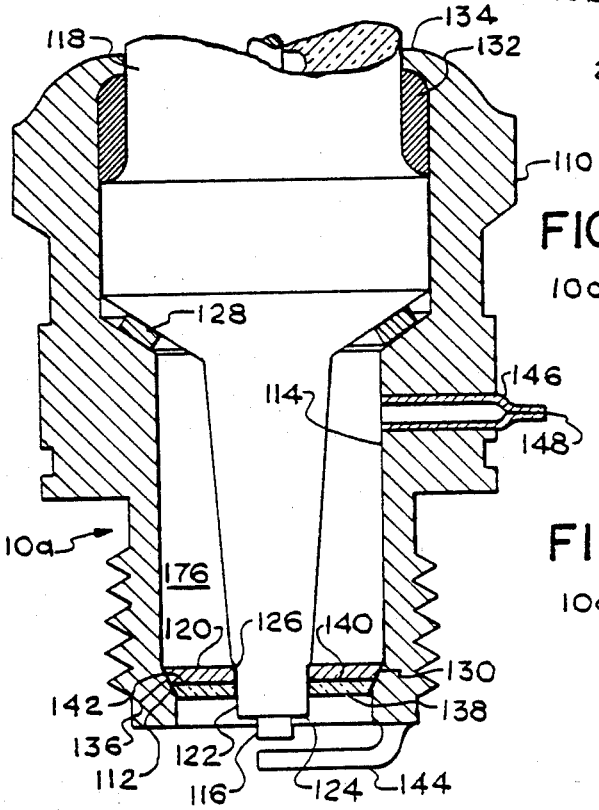
FIGS. 4–7 are fragmentary front elevational views partially in section of other designs of the spark plug of the invention ebodying heat pipes for varying the heat range thereof automatically.

In the FIG. 3 embodiment of the invention, an end wall 80 is bonded in place across the normally open lower end of the skirt 15 of an essentially conventional spark plug to form a chamber 76 between the insulator and shell. The chamber is charged with a working medium and functions as a heat pipe that maintains the firing tip at an optium operating temperature. FIG. 4 illustrates a heat pipe 176 fabricated by an alternate technique. In the FIG. 4 embodiment, the shell 110 of the spark plug **10*a* is provided with an annular ramped shoulder 112 in the lower end portion of the bore 114 thereof. During the fabrication process, the center electrode assembly 116 is positioned in the insulator or insulating core 118 and is sealed therein and the terminal stud and terminal (not shown) are installed in the usual fashion. An annular end wall 120 is slipped over a section of reduced diameter 122 in the lower end 124 of the insulator 118 and is bonded 126 in place. The usual gasket 128 is positioned on the assembled insulator assembly 118 which is then inserted into the bore 114 of the shell 110 until the outer periphery 130 of the end wall 120 abuts solidly against the annular ramp 112 in the bore of the shell. After the sillment seal 132 is installed, the insulator is locked in the shell in the usual way as by spinning down the upper rim 134. Periphery 130 of end wall 120 is welded 136 on ramp 112 such that a hermetic seal is obtained. An annular insulator 138 of electrically non-conducting material is bonded by means of a suitable bonding agent 140 on the lower face 142 of end wall 120. Electrical insulator 138 can also be a coating of a suitable non-conducting material that is coated or fused on the lower face of the end wall. After the ground electrode 144 is installed, heat pipe 176 is charged by means of fill pipe 146 and the end 148** thereof is sealed off to complete the fabrication of the spark plug.

Figure 5:
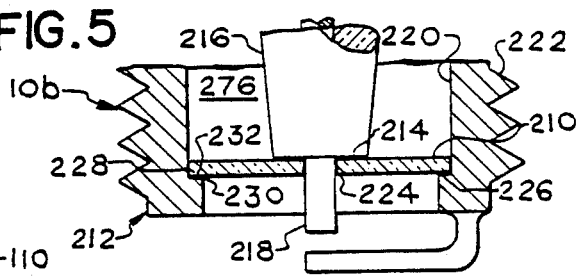

FIG. 5 illustrates a further embodiment 10*b* of the spark plug of the invention. Spark plug 10*b* has a heat pipe 276 including an end wall 210 of electrically non-conducting material in the skirt 212 thereof below the lower end 214 of the insulator nose 216 between the center electrode 218 and the bore 220 of the shell 222. It will be recognized that spart plug 10*b* of FIG. 5 is essentially identical to spark plug 10*a* of FIG. 4 and the fabrication process is similar except that the end wall is bonded 224 to the center electrode 218 below the end 214 of the insulator nose 216. Shoulder 226 to which the outer periphery 228 of the end wall is bonded 230 has an upward facing surface 232 which is normal to the surface of the shell bore 220.

Figure 6:
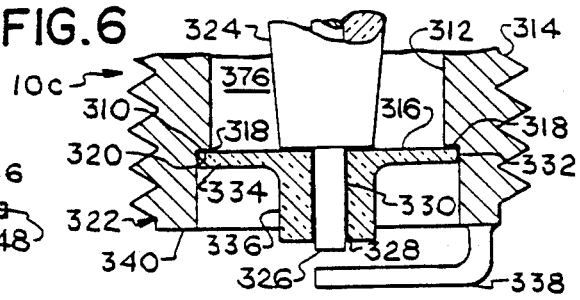

In a further embodiment of the invention shown in FIG. 6, the shoulder 310 in the bore 312 of the shell 314 of spark plug 10*c* to which the end wall 316 of the heat pipe 376 is bonded 318 has a downward facing surface 320 normal to the bore of the shell. It will be appreciated that spark plug 10*c* will be made using the steps employed in constructing a conventional spark plug with the exception of the incorporation of the heat 376 in the skirt 322 of the device. Thus, the insulating core subassembly or insulator 324, including the center electrode 326, sillment seals, and gasket, is installed in the shell 314 and is fixed therein by swaging down the upper rim of the shell in accordance with conventional manufacturing procedures. As in sparking plug 10*b* shown in FIG. 5, the insulator 324 is terminated at the shoulder 310 and the lower end of the center electrode 326 extends therefrom. End wall 316 is installed over the center electrode and the inside bore 328 is bonded 330 to the center electrode and the outer periphery 332 is bonded 318 to the shoulder and shell bore. End wall 316 preferably is fabricated out of a ceramic such as that used for the insulator 324 and is formed with an annular disk-like upper portion 334 and depending therefrom a lower cylindrical portion 336 which shields the lower end of the center electrode from erosion by cylinder combustion processes. After the end wall 316 is hermetically bonded in place, the heat pipe is charged with the working medium in the usual way. The fill tube is then sealed and the fabrication the lower edge 340 of the spark plug shell 314.

Figure 7:
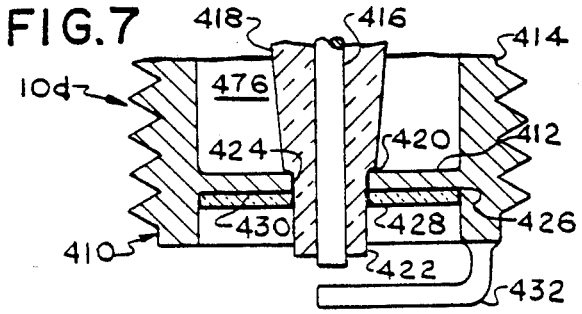

In a further embodiment illustrated in FIG. 7, a heat pipe 476 incorporated in the skirt 410 of spark plug 10*d* has an end wall 412 which is an integral part of the shell 414 thereof. In this embodiment, the center electrode 416 is installed in the insulating core subsassembly 418 which is then installed in the shell 414 employing usual industry procedures. A bonding step is then used to hermetically seal 420 the clearance between the insulator nose 422 and the annular opening 424 in the end wall 412. The fabrication of spark plug 10*d* is completed by bonding 426 an annular insulator 428 on the under surface 430 of end wall 412, welding ground electrode 432 in place, and charging and hermetically sealing the heat pipe 476.

FIG. 8 illustrates a further embodiment of the spark plug of the invention. In this embodiment, a heat pipe 576 is fabricated as a separate entity and is installed as a unit into the skirt 510 of the spark plug 10*e* in the course of the fabrication thereof. Spark plug 10*e*, with the exception of the heat pipe, is substantially of a conventional "hot" type construction. It thus has a center electrode subassembly 512 including a terminal stud 514 and terminal 516, an insulating core or insulator subassembly 518, shell 520, an inside gasket 522, sillment seals 524 and 526, and a ground electrode 528. Conventional manufacturing techniques are used to fabricate the spark plug with the additional steps of inserting the heat pipe 576 into the skirt 510 between the insulator 518 and shell 520, suitably bonding an annular electrically insulating disk 530 in place below the heat pipe, and then installing the ground electrode 528. It will be understood that the heat pipe 576 is charged with its medium ready for operation prior to being installed in the skirt of the spark plug 10*e*.

Heat pipe 576 has an annular envelope 532 having its walls 534 made out of any suitable thermally conductive material. Sone or all of the inside surfaces 536 of the envelope 532 can be provided as required with a suitable wicking system 538. The heat pipe is suitably shaped to fit closely against the insulator 518 and the bore of the shell 520 to insure a good thermal contact therewith. To insure essential intimate contact, the heat pipe envelope 532 can be made slightly larger than the volume of the skirt in which it is installed such that an interference fit with the insulator and shell is obtained.

Heat pipe 576 can be fabricated using any suitable known manufacturing technique. For example, the envelope 532 can be deep drawn from a single sheet of metal to form a cylindrical hollow annulus having an annular bottom wall portion 540 and upstanding concentric inside 542 and outside 544 wall portions. If a wicking system is used, it can be installed at this time, the working fluid can be added, and the envelope 532 can be hermetically sealed as by seam welding 546 together the upper edge portions 548 and 550 respectively of wall portions 542 and 544.

It will be appreciated that, because heat pipe 576 is contained in the skirt 510 of the spark plug, the shell 520, insulator 518, and end disk 530 thereof furnish the necessary structural integrity for the heat pipe, thus substantially relieving the heat pipe envelope 532 of that requirement. However, should it be desired to evacuate the heat pipe, its envelope 532 has to have sufficient structural strength to resist collapsing when the pressure therein is decreased. Heat pipe 676 illustrated in FIGS. 9 and 10 provides a resolution to the problem of a thin-walled envelope that can be evacuated to subatmospheric pressure. In heat pipe 676, the wicking system 610 comprises a formed resilient screen structure 612 contained within an annular hermetic envelope 614 of a thin-walled 616 construction. In this arrangement, the screen structure 612 which can be formed out of a resilient screening material such as stainless steel wire screening provides the structural strength and the walls 616 act as the containment system for the working medium. Thus, in fabricating heat pipe 676, the resilient wicking system 610 is formed into a cylindrical hollow annular structure having an annular bottom portion 618 and upstanding concentric radially inside portion 620 and radially outside portion 622. Enclosing the wicking system 610 is a thin-walled metal envelope 614 including an annular radially inside wall 624, annular radially outside wall 626, and an annular bottom wall 628. Upper edge 630, 632 of walls 624, 626 respectively are bonded together by welding 634 to thereby seal the upper end of the envelope 614. The envelope can then be evacuated by means of fill tube 636 which is then sealed and welded closed after the heat pipe is charged with its working medium and, if used, inert gas. When the envelope is evacuated, ambient pressure causes the wall 616 thereof to press inward against the resilient screen structure 612. In this design, the heat pipe is slightly oversized with respect to the interior annular volume of the spark plug skirt into which the heat pipe is fitted. This factor, plus the resiliency of the wicking structure insures that the heat pipe has the requisite thermally conductive interference fit in the spark plug skirt. If required, equally spaced U-shaped resilient clips 638 (see FIG. 10) can be provided around the annular interior of the heat pipe to furnish added structural strength.

Figure 11:
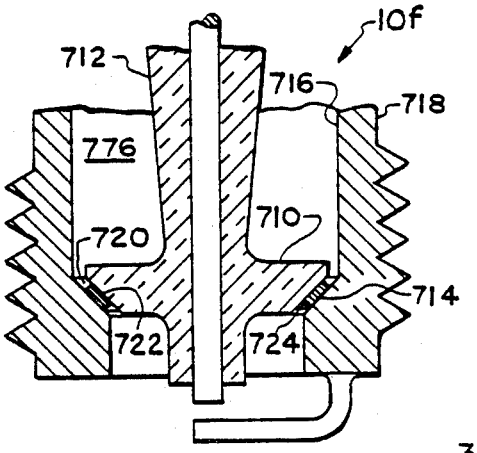
FIG. 11 is a fragmentary front elevational view partially in section of yet another design of the spark plug of the invention embodying a heat pipe for varying the heat range thereof automatically.

Various embodiments of the spark plug of the invention have been illustrated and described herein. Each of these embodiments utilizes various design details and construction techniques. It will be recognized that these variations can be interchanged as required by the requirements of any specific application of use. For example in FIG. 7 embodiment, the end wall 412 of spark plug 10*d* is an integral extension of shell 414 thereof. In FIG. 11, the end wall 710 of the heat pipe 776 of the spark plug 10*f* is an integral extension of the insulating core 712 thereof. As shown, end wall extends radially outward to a shoulder 714 in the bore 716 of the shell 718. The gap 720 between the outer periphery 772 of the end wall 710 and the shoulder 714 is hermetically sealed as by bonding or by a suitable gasket 724. Spark plug 10*f* in all other design and fabrication details is substantially identical to, for example, spark plug 10*a* of the FIG. 4 embodiment of the invention.

Although shown and described in what are believed to be the most practical and preferred embodiments, it is apparent that departures from the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

Having thus described my invention, what I claim is:

1. A spark plug having an outer terminal end and an inner firing end adapted to be installed in the cylinder head of an engine, said spark plug including a hollow metal shell having external threads on the inner end thereof for securing said spark plug for operation in said cylinder head, said cylinder head being furnished with cooling means providing a heat sink for said spark plug, an electrical insulating core having an inner end received in the bore of said shell and including a nose portion spaced radially inward from said shell bore, means for sealing said insulating core in a gas-tight relationship in said shell, a center electrode carried in said insulating core with the inner end of said center electrode projecting therefrom, said shell having ground electrode means disposed in a cooperative relationship with said center electrode inner end and forming a spark gap therebetween, an electrical terminal at the outer end of said center electrode for connection into the ignition system of said engine, the improvment comprising a heat pipe disposed in good heat transfer relationship between said insulating core and said shell bore, said heat pipe being charged with a volatile working medium and being thermally non-conducting in one temperature range and thermally conducting in a second design temperature range to transfer heat from said firing end to said shell for dissipation therefrom whereby the heat range of said spark plug is controlled thereby.

2. The spark plug defined in claim 1 wherein the design temperature range is from about 450° C. (842° F.) to about 850° C. (1562° F.).

3. The spark plug defined in claim 1 wherein the heat pipe comprises a hermetic hollow annular chamber having an upper end defined by the insulating core sealing means, a lower end defined by an end wall, a radially inside annular wall defined by the insulating core, and a radially outside annular wall defined by the shell bore.

4. The spark plug defined in claim 1 wherein the heat pipe comprises a hermetic hollow annular envelope installed in the skirt of said spark plug, said envelope having an upper and a lower wall, a radially inside wall and a concentric radialy outside wall.

5. The spark plug defined in claim 3 wherein the heat pipe includes wick means on at least a portion of the interior surfaces thereof, with the movement of at least a portion of the volatile working medium in its liquid phase being through said wick means.

6. The spark plug defined in claim 1 wherein said spark plug has regions at different temperatures during the operation thereof, the volatile working medium pumping heat from the regions of higher temperature to regions of lower temperature by evaporating from a liquid phase to a vapor phase adjacent said regions of higher temperature, condensing from said vapor phase to said liquid phase adjacent said regions of lower temperature, and returning in said liquid phase to said regions of higher temperature.

7. The spark plug defined in claim 6 wherein a region of higher temperature is the nose portion of the insulating core and a region of lower temperature is the shell of said spark plug.

8. The spark plug defined in claim 3 wherein the end wall of the heat pipe extends between the center electrode below the lower end of the insulating core and the shell bore.

9. The spark plug defined in claim 3 wherein the end wall of the heat pipe is an integral annular extension of the shell bore.

10. The spark plug defined in claim 3 wherein the end wall of the heat pipe is an integral annular extension of the insulating core.

11. The spark plug defined in claim 3 wherein the lower end of the shell bore is provided with an annular shoulder and wherein the outer peripheral portion of the wall engages said shoulder.

12. The spark plug defined in claim 11 wherein the annular shoulder has a diameter greater than the shell bore.

13. The spark plug defined in claim 11 wherein the annular shoulder has a diameter smaller than the shell bore.

14. The spark plug defined in claim 3 wherein the end wall is fabricated out of an electrical insulator and wherein the end wall includes a cylindrical lower portion concentric with the lower end of the center electrode.

15. The spark plug defined in claim 4 wherein the heat pipe comprises a structure provided with a resilient wicking system having a lower end defined by an annular end portion, an upstanding radially inside portion, and an upstanding radially outside portion enclosed within a concentric annular thin-walled impervious envelope having an annular lower end wall, an upstanding radially inside wall, and an upstanding radially outside wall, the upper edge portions of said concentric annular walls beings brought together and bonded to hermetically seal said envelope, wherein said thin-walled envelope provides a hermetic containment system for the working medium and said resilient wicking system provides the structural strength to prevent the collapse of said envelope when the pressure therein is reduced.

16. The spark plug defined in claim 4 wherein the heat pipe includes wick means on at least a portion of the interior surfaces thereof, with the movement of at least a portion of the volatile working medium in its liquid state being through said wick means.

* * * * *